US007953353B2

(12) United States Patent
Furuya et al.

(10) Patent No.: US 7,953,353 B2
(45) Date of Patent: May 31, 2011

(54) DEVELOPING DEVICE, METHOD OF PRODUCING DEVELOPING DEVICE, AND IMAGE FORMING APPARATUS

(75) Inventors: Nobumasa Furuya, Kanagawa (JP); Toshio Hino, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/550,627

(22) Filed: Aug. 31, 2009

(65) Prior Publication Data

US 2010/0247165 A1 Sep. 30, 2010

(30) Foreign Application Priority Data

Mar. 26, 2009 (JP) ..... P2009-075587

(51) Int. Cl.
*G03G 15/09* (2006.01)

(52) U.S. Cl. ..... 399/277; 399/269

(58) Field of Classification Search ..... 399/269, 399/277

See application file for complete search history.

(56) References Cited

U.S. PATENT DOCUMENTS 4,960,070 A * 10/1990 Nishimura ..... 399/277 X
5,630,201 A * 5/1997 Suzuki et al. ..... 399/269
5,987,288 A * 11/1999 Mori et al. ..... 399/269
2003/0091372 A1* 5/2003 Shigeta et al. ..... 399/277 X
2003/0185600 A1* 10/2003 Mabuchi et al. ..... 399/269
2009/0162108 A1* 6/2009 Yoshimoto ..... 399/277 X

FOREIGN PATENT DOCUMENTS

JP 05-040410 2/1993
JP 06-194961 A * 7/1994
JP 2008-046170 2/2008

OTHER PUBLICATIONS

Machine translation of JP 05-040410 A dated Oct. 4, 2010.*

* cited by examiner

*Primary Examiner* — Sophia S Chen
(74) *Attorney, Agent, or Firm* — Morgan, Lewis & Bockius LLP

(57) ABSTRACT

A developing device includes a magnet roll magnetized with plural magnetic poles including a main magnetic pole, a sleeve in a cylindrical shape which is arranged so as to be opposed to an image holding body, and a supporting frame that stably supports the magnet roll in a manner of restraining the magnet roll from rotating in the tangential direction, and supports the sleeve so as to rotate in the tangential direction around the magnet roll. The magnet roll is so arranged that the main magnetic pole is opposed to the image holding body, and a point on the peripheral face where magnetic flux density of the main magnetic pole in the tangential direction at a position along the peripheral face of the magnet roll is zero is set at a position predetermined with respect to a position where the magnet roll comes most closely to the image holding body.

8 Claims, 8 Drawing Sheets

DEVELOPING DEVICE, METHOD OF PRODUCING DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2009-075587 filed on Mar. 26, 2009.

BACKGROUND

1. Technical Field

The present invention relates to a developing device for visualizing a latent image formed by a difference in electrostatic potential by applying toner to the latent image, a method of producing the developing device, and an image forming apparatus employing this developing device.

2. Related Art

In a developing device for forming a visual image by transposing toner to an electrostatic latent image on an image holding body, two-component developing agent having toner and magnetic carrier mixed or one-component developing agent having magnetic toner as a main component has been widely used. Such developing agent is magnetically attracted to a peripheral face of a developing roll, and transported to a position opposed to the image holding body. Then, a developing bias voltage is applied between the image holding body and the developing roll, and within an electric field which has been created, the toner is transferred to the electrostatic latent image on the image holding body thereby to form a visual image.

As the developing roll as described above, there has been widely used a developing roll including a magnet roll which is stably held so as not to rotate, and a thin sleeve in a cylindrical shape which is held around the magnetic roll so as to rotate. The magnet roll is magnetized with plural magnetic poles in a tangential direction, and magnetically attracts the magnetic toner or the magnetic carrier to a surface of the sleeve thereby to transport the developing agent in the tangential direction with rotation of the sleeve. On this occasion, the developing agent held on the sleeve forms a magnetic brush in which the magnetic toner or the magnetic carrier is continued in a shape of straw-stack, on the magnetic poles of the magnet roll. Particularly, on the developing magnetic pole which is provided at a position opposed to the image holding body, a large amount of toner is transposed onto the image holding body owing to the shape of straw-stack, whereby development with sufficient density is carried out.

Condition of the magnetic brush on the developing magnetic pole varies depending on distribution of magnetic flux density in vicinity of the position where the developing roll is opposed to the image holding body.

On the other hand, recently, in an image forming apparatus for forming an image using toner, it has been more and more desired to conduct a process at high speed, and an art of supplying a sufficient amount of developing toner to an image holding body which is rotating at high speed has been proposed.

SUMMARY

According to an aspect of the invention, there is provided a developing device including: a magnet roll magnetized with a plurality of magnetic poles including a main magnetic pole which are arranged in a tangential direction; a sleeve in a cylindrical shape which is arranged so as to be opposed to an image holding body having an endless peripheral face on which a latent image is formed by a difference in electrostatic potential and to which developing agent is supplied to an outer circumference face of the sleeve; and a supporting frame that stably supports the magnet roll in a manner of restraining the magnet roll from rotating in the tangential direction, and supports the sleeve so as to rotate in the tangential direction around the magnet roll. The magnet roll is so arranged that the main magnetic pole is opposed to the image holding body, and a point on the peripheral face where magnetic flux density of the main magnetic pole in the tangential direction at a position along the peripheral face of the magnet roll is zero is set at a position predetermined with respect to a position where the magnet roll comes most closely to the image holding body.

BRIEF DESCRIPTION OF THE DRAWINGS

Exemplary embodiments of the invention will be described in detail based on the following figures, wherein.

DETAILED DESCRIPTION

Now, an exemplary embodiment of the invention according to this application will be described referring to FIGS. 1 to 9.

Figure 1:
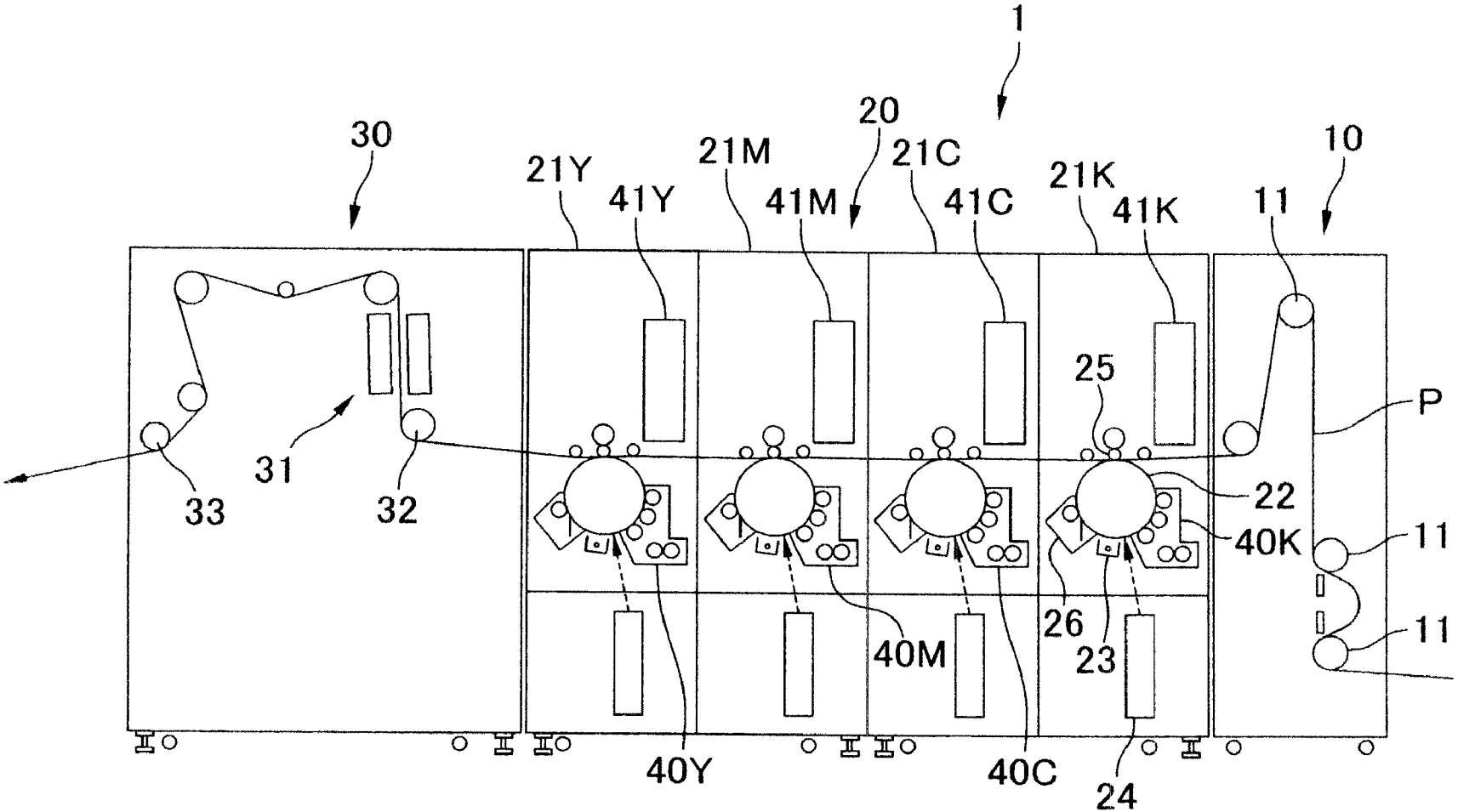
FIG. 1 is a schematic structural view showing an image forming apparatus in an exemplary embodiment of the present invention.

FIG. 1 is a schematic structural view showing an image forming apparatus in an exemplary embodiment of the present invention.

The image forming apparatus 1 is a large-sized machine for forming images on a continuous paper which is transferring material at high speed, and includes a paper transporting part 10 for transporting and supplying the continuous paper, an image forming part 20 for forming the images and transferring them to the continuous paper, and a fixing part 30 for fixing the transferred images.

The paper transporting part 10 is provided with a plurality of winding rollers 11 for winding and transporting the continuous paper, and so adapted as to transport the continuous paper P to the image forming part 20, while applying tension to the continuous paper P.

In the image forming part 20, four image forming units 21K, 21C, 21M and 21Y which transfer toners of black (K), cyan (C), magenta (M), and yellow (Y) thereby to form toner images are provided in this order from an upstream side, at substantially equal intervals along a transporting path.

The image forming units 21K, 21C, 21M and 21Y are respectively provided with photosensitive drums 22. Each of the photosensitive drums 22 includes a cylindrical member formed of electrically conductive material which has a photoconductive layer formed on an outer peripheral face thereof. Around the photosensitive drum 22, there are provided an electrifying device 23 for uniformly electrifying a surface of the photosensitive drum 22, an exposing device 24 for irradiating an image light to the photosensitive drum 22 which has been electrified thereby to form a latent image on the surface, a developing device 40 for transposing toner to the latent image on the photosensitive drum 22 thereby to form a toner image, a transferring roll 25 for transferring the toner image which has been formed on the photosensitive drum 22 to the continuous paper, and a cleaning device 26 for removing the toner which remains on the photosensitive drum 22 after the toner image has been transferred.

The four image forming units 21K, 21C, 21M and 21Y have the same structure, except that their developing devices 40 contain the toners having respectively different colors. In addition, toner replenishing containers 41K, 41C, 41M and 41Y are provided above the respective developing devices 40K, 40C, 40M and 40Y. The toner replenishing containers 41K, 41C, 41M and 41Y replenish the toners having the colors corresponding to the toners contained in the respective developing devices 40K, 40C, 40M and 40Y to the relevant developing devices 40. Therefore, the toners which are consumed by development can be replenished.

In the fixing part 30 provided in a downstream of the image forming part 20, there is provided a flash fixing device 31 for fixing an unfixed toner image which has been transferred on the continuous paper, and the continuous paper having the toner image transferred thereon is wound around a transporting roll 32 to be guided to the flash fixing device 31. The flash fixing device 31 heats up the toner with radiant heat from a heating source thereby to fix the toner image on the continuous paper. The continuous paper having the toner image fixed thereon is wound around a discharging roll 33 and discharged to an exterior of the apparatus.

Figure 2:
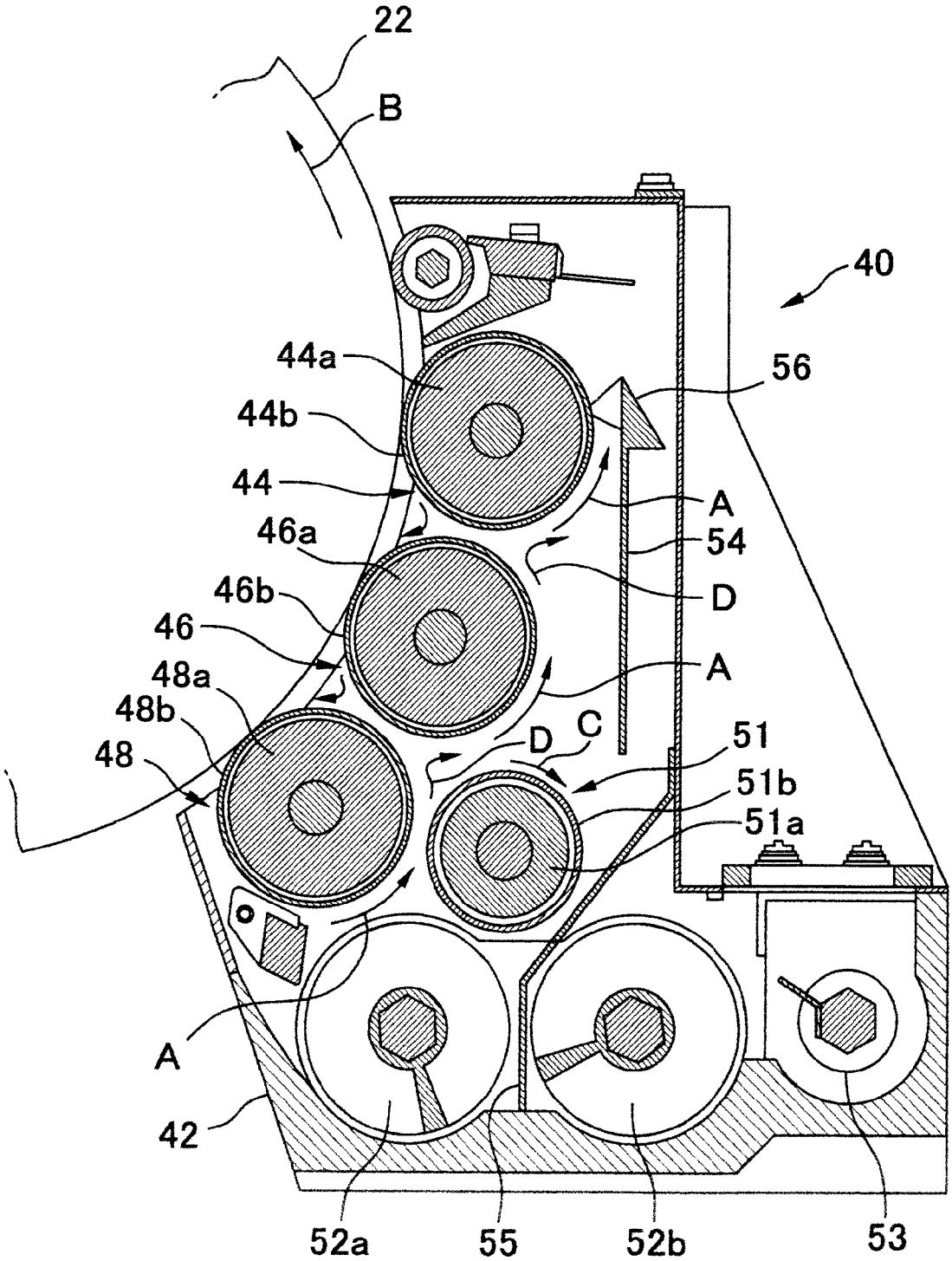
FIG. 2 is a schematic sectional view showing a developing device provided in the image forming apparatus as shown in FIG. 1.

As shown in FIG. 2, the developing device 40 includes a housing 42 which contains two-component developing agent composed of toner and magnetic carrier, and at the same time, functions as a supporting frame body. In the housing 42, a first developing roll 44, a second developing roll 46, and a third developing roll 48 are arranged so as to be closely opposed to a peripheral face of the photosensitive drum 22, in this order from a downstream side in a rotation direction of the photosensitive drum 22. Moreover, a supplying roll 51 is arranged close to the third developing roll 48, in order to supply the two-component developing agent to the third developing roll 48. Below the supplying roll 51, there are provided two agitating transporting members 52*a* and 52*b* for transporting the toner and the magnetic carrier while agitating them, and a toner supplying member 53 for supplying the toner which has been supplied from the toner replenishing container 41 to working areas of the toner agitating transporting members 52*a* and 52*b*.

Further, a guide plate 54 is provided at a back side of the three developing rolls 44, 46 and 48, in order to guide the developing agent which has detached from the developing rolls 44, 46 and 48 to the working areas of the toner agitating transporting members 52*a* and 52*b*.

Reference numeral 56 represents a layer restraining member for restraining a layer of the two-component developing agent which has been attracted to the peripheral face of the first developing roll 44.

The housing 42 contains the two-component developing agent, and at the same time, supports the developing rolls 44, 46 and 48, the supplying roll 51, the agitating transporting members 52*a* and 52*b*, and the toner supplying member 53. Moreover, the housing 42 is open at a position opposed to the photosensitive drum 22, and at this position, the developing rolls 44, 46, 48 are respectively arranged so as to be closely opposed to the photosensitive drum 22.

The supplying roll 51 includes a magnet roll 51*a*, and a tubular sleeve 51*b* which is rotatably provided around the magnet roll 51*a*. The magnet roll 51*a* is magnetized with an attracting pole for attracting the two-component developing agent, a transporting pole for transporting the two-component developing agent to an adjacent pole, a supplying pole for supplying the two-component developing agent to the third developing roll 48, and so on. The tow-component developing agent is supplied to the third developing roll 48 with rotation of the sleeve 51*b*, and the two-component developing agent which has remained after the supply is returned to the working areas of the agitating transporting members 52*a* and 52*b*.

The two agitating transporting members 52*a* and 52*b* which are screws having rotary blades are arranged at both sides of a partition wall 55 which has openings (not shown) near both ends thereof in an axial direction. The agitating transporting members 52*a* and 52*b* transport the developing agent in an axial direction of their rotation shafts, and agitate the two-component developing agent, while rotating so that the developing agent may be transported in opposite directions to each other. In this manner, the two-component developing agent is shifted between their agitating areas through the openings formed in the partition wall 55, and thus, the two-component developing agent circulates between the two areas separated by the partition wall 55.

The toner supplying member 53 is arranged at a position where the toner is replenished from the toner replenishing container 41 (not shown in FIG. 2), and supplies the toner to the housing 42, according to an amount of the toner which has been consumed by the development.

The first developing roll 44, the second developing roll 46, and the third developing roll 48 include magnet rolls 44*a*, 46*a* and 48*a* which are respectively fixed to and supported by the housing 42, and tubular sleeves 44*b*, 46*b* and 48*b* which are supported so as to rotate along outer peripheral faces of these magnet rolls. The magnet rolls 44*a*, 46*a* and 48*a* are magnetized with a plurality of magnetic poles along a tangential direction, in order to magnetically attract the two-component developing agent to outer peripheral faces of the sleeves 44*b*, 46*b* and 48*b*. The respective magnetic poles are provided substantially equally in an axial direction of the magnet rolls 44*a*, 46*a* and 48*a*, and create substantially same magnetic fields around them at any position in the axial direction. The sleeves 44*b*, 46*b*, 48*b* are arranged at a determined distance from the peripheral face of the photosensitive drum 22, and rotate in directions of arrow marks A in FIG. 2, so that the peripheral faces of the magnet rolls 44*a*, 46*a*, 48*a* move in opposite directions to the peripheral face of the photosensitive drum 22 which rotates in a direction of an arrow mark B in FIG. 2.

A plurality of the magnetic poles provided on the magnet rolls 44*a*, 46*a*, 48*a* include, for example, an attracting pole for attracting the two-component developing agent, a transporting pole for transporting the two-component developing agent to an adjacent pole, a developing pole for supplying the toner to the photosensitive drum 22, a removing pole for removing the two-component developing agent, and so on. In this manner, the sleeves 44*b*, 46*b*, 48*b* rotate along the peripheral faces of the magnet rolls 44*a*, 46*a*, 48*a*, whereby the two-component developing agent can be shifted among the three developing rolls 44, 46, 48 and the toner can be transposed to the photosensitive drum 22.

The first developing roll 44 is arranged in the most downstream in the rotation direction of the photosensitive drum 22, among the three developing rolls 44, 46, 48, and is the last developing roll for transposing the toner to the photosensitive drum 22. Therefore, the first developing roll 44 is so adjusted as to regulate an amount of the toner which has been transposed on the photosensitive drum 22 by the second developing roll 46 or the third developing roll 48 thereby to form a favorable image.

Figure 3:
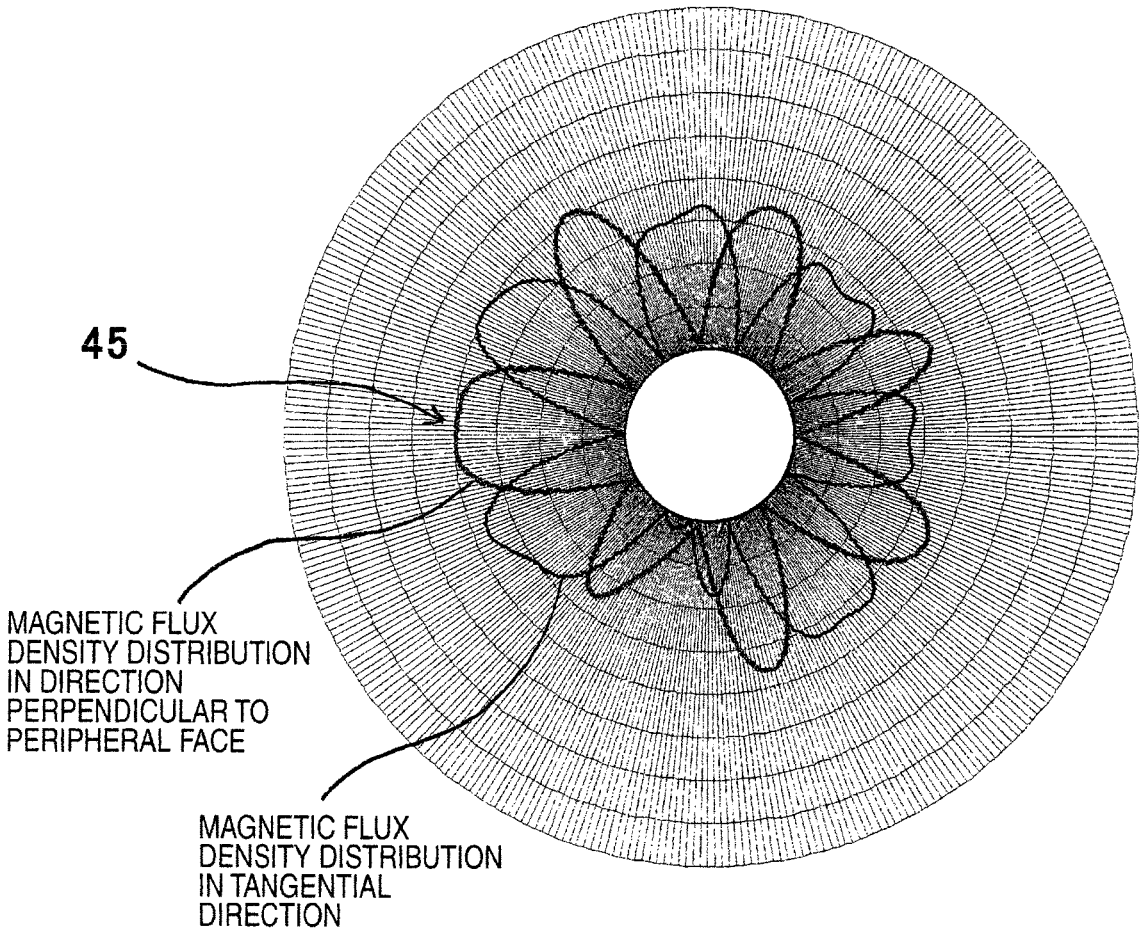
FIG. 3 is a chart showing a magnetized pattern of a first developing roll provided in the developing device as shown in FIG. 2.

The magnetic poles provided on the first magnet roll 44*a* can be arranged in such a magnetized pattern as shown in FIG. 3, for example, and the developing pole, that is, the main magnetic pole is provided at the position where it comes most closely to the photosensitive drum 22. It is possible to regulate the amount of the developing toner, by adjusting the position of the main magnetic pole 45 with respect to the photosensitive drum 22, by adjusting a distance between the photosensitive drum 22 and the sleeve 44*b*, and by other means.

The main magnetic pole 45 of the first developing roll 44 is a so-called wide width pole, and provided in such a manner that a series of regions where distribution of magnetic flux density in a direction perpendicular to a peripheral face of the first magnet roll 44*a* is more than 90% of a peak value may occupy more than 40% of an entire width of the main magnetic pole 45. That is, the distribution of the magnetic flux density in the perpendicular direction shows a large value approximate to the peak value in a wide range near the position of the peak value, and the region where the distribution is more than 90% of the peak value is not divided in two or more, and definite peak values of more than two will not appear in the main magnetic pole.

Figure 4:
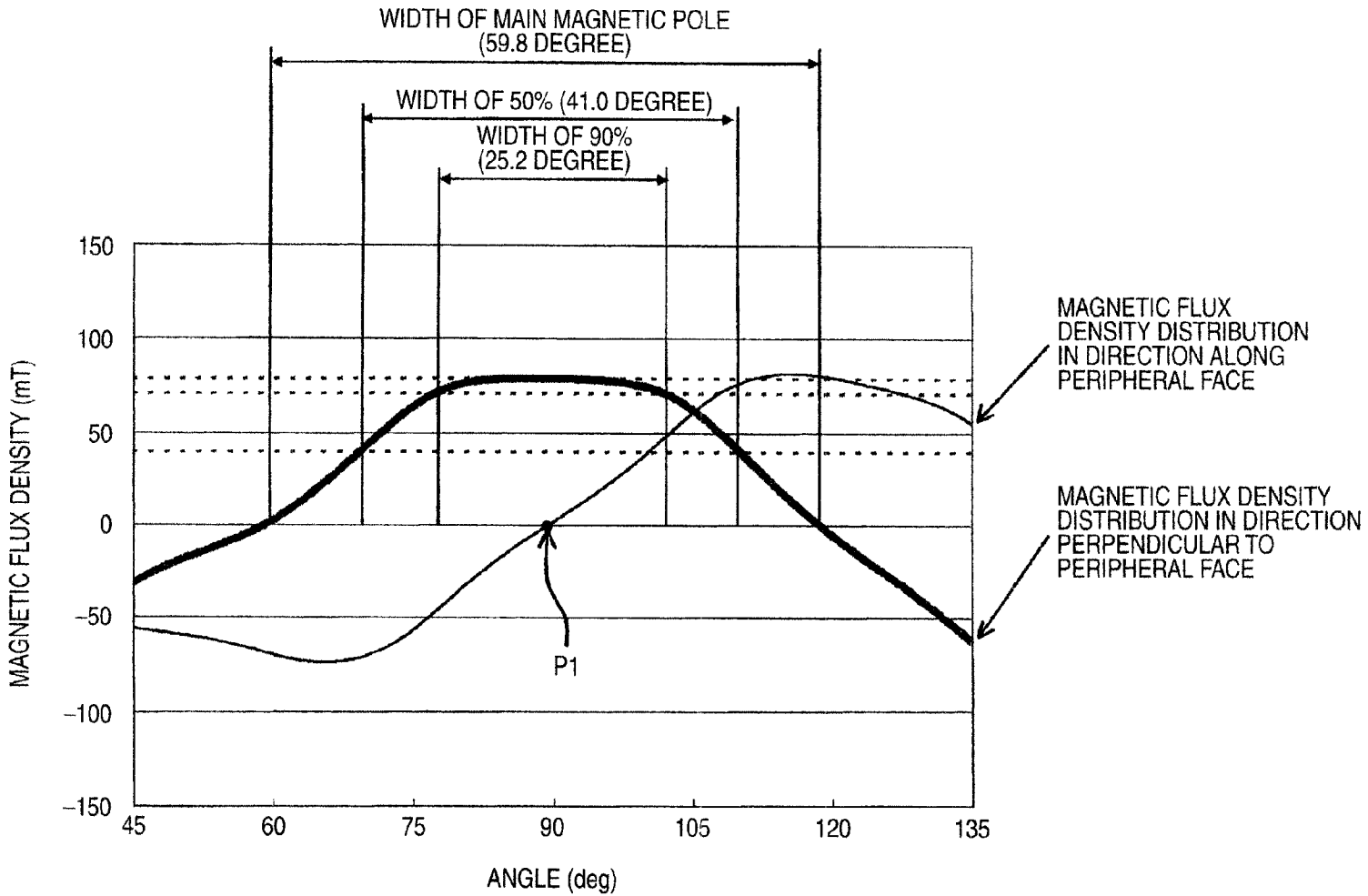
FIG. 4 is a graph showing magnetic flux density of a main magnetic pole of the first developing roll as shown in FIG. 3, in a direction perpendicular to a peripheral face of the developing roll and in a direction along the peripheral face.

It is to be noted that the entire width of the main magnetic pole means a width between positions where polarity is reversed between the adjacent magnetic poles, as shown in FIG. 4.

In the main magnetic pole 45 which is thus formed as the wide width pole, the magnetic flux density in a tangential direction is measured, and a point where the magnetic flux density becomes zero is set as a reference point P1. The magnet roll 44*a* is fixed in such a manner that this reference point P1 may be a predetermined position with respect to the closest position to the photosensitive drum 22.

Figure 5:
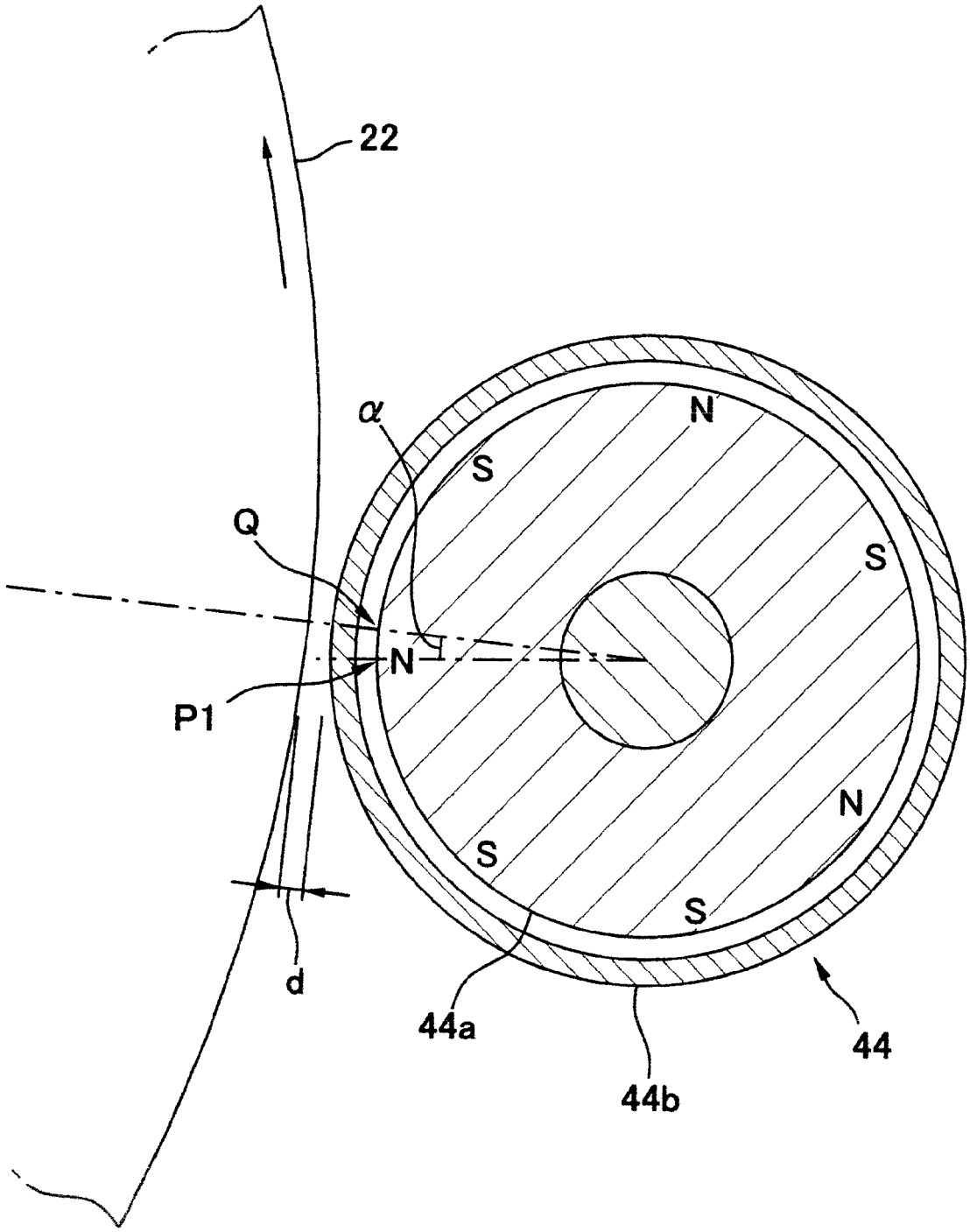
FIG. 5 is an enlarged sectional view of a part where the first developing roll provided in the developing device as shown in FIG. 2 is opposed to a photosensitive drum.

In this exemplary embodiment, as shown in FIG. 5, the magnet roll 44*a* is set in such a manner that a deviation angle $\alpha$ from a point Q where the magnet roll 44*a* is at the closest position to the photosensitive drum 22, is deviated at 4.5 degree to the upstream side in the rotation direction of the photosensitive drum 22. The deviation angle $\alpha$ is a central angle of the magnet roll from a line which connects centers of the photosensitive drum 22 and the first developing roll 44 to a position of the reference point P1. Moreover, a distance d between the first sleeve 44*b* and the photosensitive drum 22 is set to be 0.45 mm.

It is to be noted that the magnetic flux density in the tangential direction is a component of the magnetic flux density in a tangential direction at a position along the tangential direction of the magnet roll 44*a*.

The second developing roll 46 is positioned at the upstream side of the first developing roll 44 and at the downstream side of the third developing roll 48, in a moving direction of the peripheral face of the photosensitive drum 22, that is, positioned at a middle of the three developing rolls 44, 46 and 48. The second magnet roll 46*a* can have such a magnetized pattern as shown in FIG. 6, for example.

Figure 6:
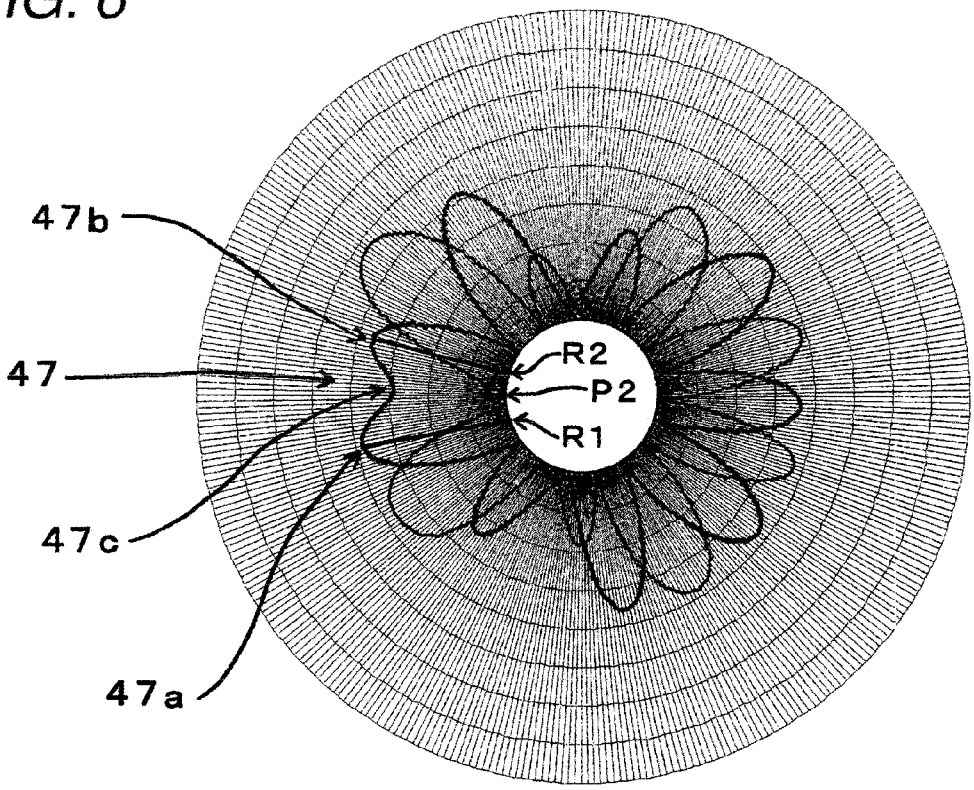
FIG. 6 is a chart showing a magnetized pattern of a second developing roll provided in the developing device as shown in FIG. 2.

As shown in FIG. 6, the main magnetic pole 47 of the second developing roll 46 is so magnetized that it has two maximal values 47*a*, 47*b* in distribution of the magnetic flux density in the perpendicular direction, and a minimal value 47*c* existing between them is less than 90% of a peak value with the same polarity. Then, by setting a point at an equal distance from two positions R1 and R2 on the peripheral face having the maximal values, as a reference point P2, and by setting a deviation angle of the main magnetic pole 47 from the closest position to the photosensitive drum 22, the second magnet roll 46*a* is fixed.

In this exemplary embodiment, the deviation angle from the closest position to the photosensitive drum 22 is set to be 0 degree based on the reference point P2, and a distance between the second sleeve 46*b* and the photosensitive drum 22 is set to be 1.05 mm.

Figure 7:
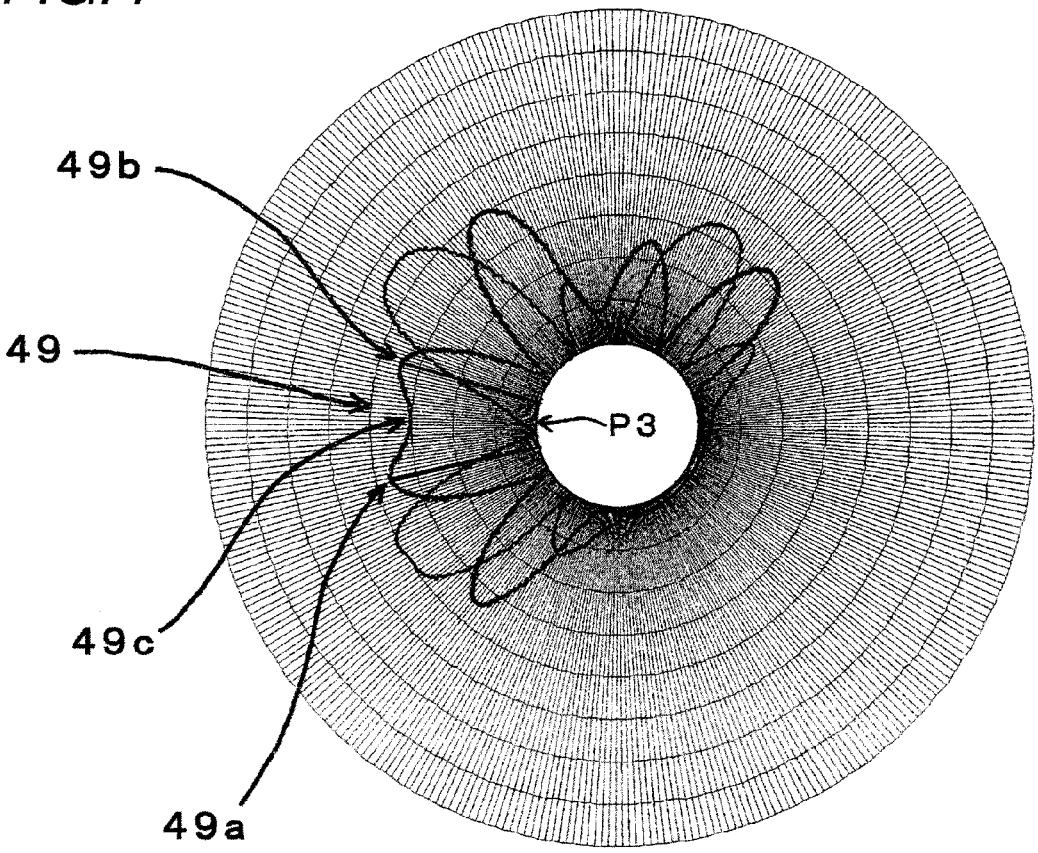
FIG. 7 is a chart showing a magnetized pattern of a third developing roll provided in the developing device as shown in FIG. 2.

The third developing roll 48 is arranged in the most upstream in the rotation direction of the photosensitive drum 22, and the third magnetic roll 48*a* can have such a magnetized pattern as shown in FIG. 7, for example.

A main magnetic pole 49 of the third magnet roll 48*a* has two maximal values 49*a*, 49*b* in the distribution of the magnetic flux density in the perpendicular direction, and a minimal value 49*c* existing between them is less than 90% of a peak value with the same polarity, in the same manner as the second magnet roll 46*a*. Then, the magnet roll 48*a* is fixed, by setting a point at an equal distance from two positions on a peripheral face having the maximal values as a reference point P3, and by setting the position of the magnetic pole.

In this exemplary embodiment, the deviation angle of the reference point P3 from the closest position to the photosensitive drum 22 is set to be 0 degree, and a distance between the third sleeve 48*b* and the photosensitive drum 22 is set to be 1.65 mm.

Although in this exemplary embodiment, the reference points P2 and P3 of the second developing roll 46 and the third developing roll 48 are set at the equal distance from the two positions having the maximal values, it is also possible to set one of the positions having the maximal values as the reference point.

The developing device as described above is operated as follows.

The two-component developing agent contained in the housing 42 is agitated by the agitating transporting members 52*a* and 52*b*, and supplied to the surface of the supplying roll 51. The toner which has been attracted to the surface of the sleeve 51*b* of the supplying roll 51 by the magnetic poles provided in the magnet roll 51*a* of the supplying roll 51 is supplied to the third developing roll 48 by the sleeve 51*b* which rotates in a direction of an arrow mark C in FIG. 2. Then, the toner is held on the third sleeve 48*b* to be transported, and shifted to the second developing roll 46 by action of the magnetic poles at a position opposed to the second developing roll 46, as shown by an arrow mark D in FIG. 2. Further, the toner is transported at a back side of the second developing roll 46, that is, at an opposite side to a part opposed to the photosensitive drum 22, thereby to be shifted from the second developing roll 46 to the first developing roll 44.

The layer restraining member 56 is provided in vicinity of the peripheral face of the first developing roll 44, and an amount of the developing agent to be held on the first sleeve 44*b* is restrained at this position. Then, the redundant two-component developing agent falls along the guide plate 54 to a bottom part of the housing 42 where the agitating transporting members 52*a* and 52*b* are arranged.

The two-component developing agent which has been attracted to the peripheral face of the first developing roll 44 is transported to a developing area which is opposed to the photosensitive drum 22, and the toner is transposed to an electrostatic latent image on the photosensitive drum 22 by a developing bias voltage which has been applied between the first developing roll 44 and the photosensitive drum 22. The two-component developing agent which has passed the developing area is transported from the first developing roll 44 to the second developing roll 46 by actions of the magnetic poles. After the second developing roll 46 has passed the developing area opposed to the photosensitive drum 22 and worked for the development, the two-component developing agent is shifted to the third developing roll 48. In the same manner, after the third developing roll 48 has passed the developing area opposed to the photosensitive drum 22, the two-component developing agent is removed by the removing pole formed in the third magnet roll 48*a*, and returned to a range where agitating actions of the agitating transporting members 52*a* and 52*b* are extended.

After the surface of the photosensitive drum 22 has been uniformly electrified, an electrostatic latent image is formed on the surface by irradiation of an image light by the exposing device 24, and the photosensitive drum 22 pass the respective developing areas opposed to the three developing rolls 44, 46 and 48. The developing bias voltage is applied between the developing rolls 44, 46 and 48 and the photosensitive drum 22, and the toner is transposed to the electrostatic latent image on the photosensitive drum 22 in an electric field which has been thus created.

In each of the third developing roll 48 and the second developing roll 46, the position of the main magnetic pole and the distance from the photosensitive drum 22 are so set that a large amount of the toner can be transposed to the photosensitive drum 22. In this manner, when the photosensitive drum 22 passes the positions opposed to the third developing roll 48 and the second developing roll 46, a sufficient amount of the toner capable of forming an image having high density, even though the peripheral face of the photosensitive drum 22 moves at high speed, is transposed to the electrostatic latent image.

Figure 8:
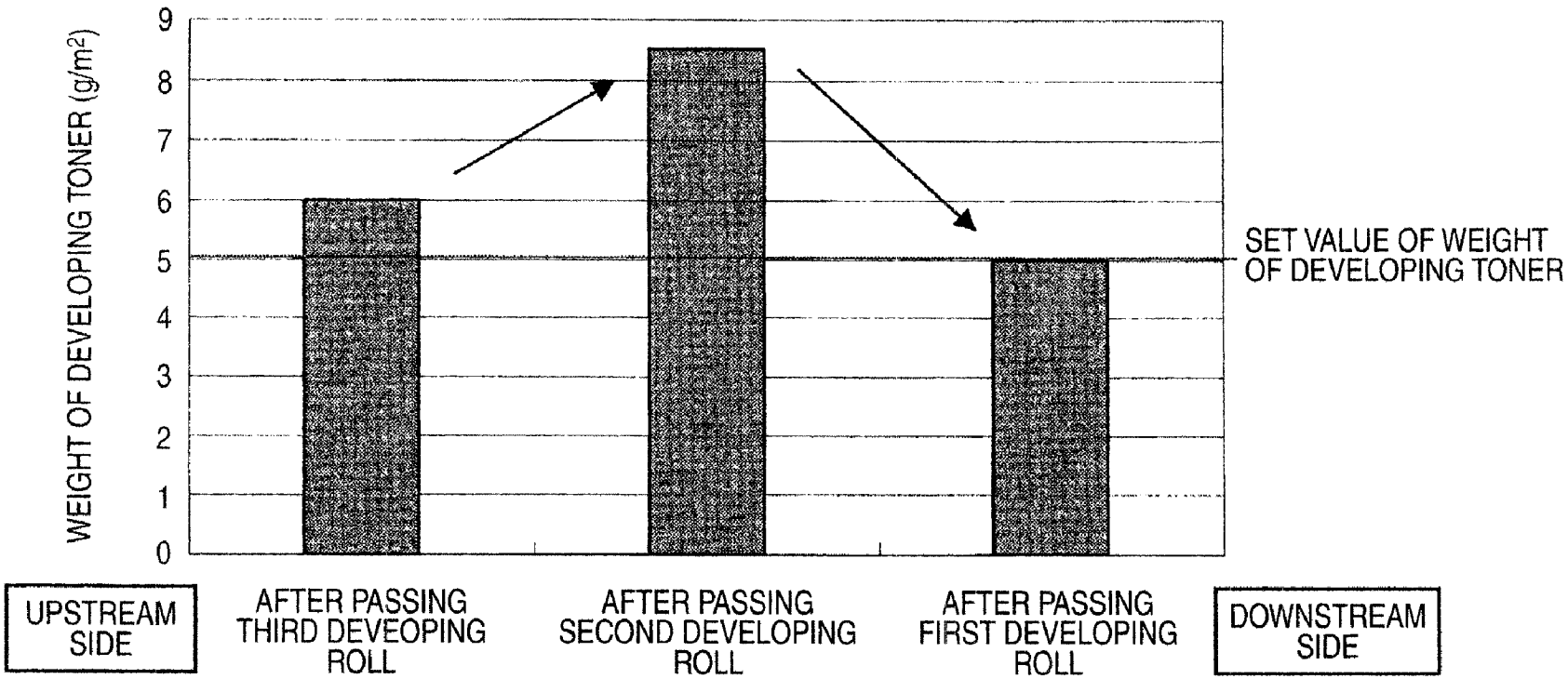
FIG. 8 is a graph showing changes in amount of developing toner on the photosensitive drum which has passed the positions opposed to the three developing rolls.

On the other hand, in the first developing roll 44, the main magnetic pole 45 is set at the deviation angle of 4.5 degree to the upstream side in the moving direction of the peripheral face of the photosensitive drum 22, and the distance from the peripheral face of the photosensitive drum 22 is set to be 0.45 mm, which is smaller than in the third developing roll 48 and the second developing roll 46. Accordingly, the toner which has been transposed on the photosensitive drum 22 by the third developing roll 48 and the second developing roll 46 is decreased by scavenging, that is, scraping action of the first developing roll 44, as shown in FIG. 8. By regulating the amount of the toner which has been developed on the photosensitive drum 22 in this manner, an image which is favorable in uniformity, granularity, and reproducing performance of fine lines can be formed.

Then, influences of the distribution of the magnetic flux density of the main magnetic poles in the developing rolls, positions of the magnetic poles, and the distances between the photosensitive drum and the developing rolls exerted on developing performance will be described.

In the high speed image forming apparatus, development with sufficient density must be performed on the photosensitive drum which is moving at high speed, and it is possible to use, as the main magnetic pole, the wide width pole having a wide area where the magnetic density in a direction perpendicular to the peripheral face of the photosensitive drum is high. In case where the main magnetic pole is provided in this manner, a large number of piles of the magnetic carrier are erected on the main magnetic pole, and hence, a surface area of the magnetic brush for supplying the adhered toner is increased. As the results, it is possible to increase a developing amount, by transposing a large amount of the toner to the electrostatic latent image which has been formed on the photosensitive drum. However, in case where the photosensitive drum rotates at high speed, a scavenging force of the magnetic brush in a shape of straw-stack for rubbing the peripheral face of the photosensitive drum and scraping off the adhered toner is also increased, which sometimes results in decrease of the amount of the developing toner. Therefore, it is necessary to regulate the amount of the developing toner to be transposed to the electrostatic latent image on the photosensitive drum by the developing rolls, with respect to the scavenging amount.

In the developing device provided with the three developing rolls as in the exemplary embodiment, the first developing roll which is arranged in the most downstream of the photosensitive drum 22 simultaneously performs the scavenging (scraping) operation of the toner which has been developed by the second and third developing rolls 46 and 48 which are arranged at the upstream side, and additional development of the toner to the photosensitive drum 22. Therefore, a final amount of the developing toner is represented by the following formula.

| | |
|---|---|
| The final amount of the developing toner=(an amount of developing toner by the second developing roll 46+an amount of developing toner by the third developing roll 46 | Member 1 |
| −(a scavenging amount by the first developing roll 44) | Member 2 |
| +(an amount of additional developing toner by the first developing roll 44) | Member 3 |

The scavenging amount by the first developing roll 44 in Member 2, and the amount of the additional developing toner in Member 3 are influenced by the deviation angle $\alpha$ of the main magnetic pole 45 of the first magnet roll 44*a* with respect to the photosensitive drum 22, and the distance d between the peripheral face of the first developing roll 44 and the peripheral face of the photosensitive drum 22. Specifically, when the deviation angle $\alpha$ of the main magnetic pole 45 of the first magnet roll 44*a* approaches 0 degree, the magnetic brush is in the most upright state, and the surface area of the magnetic brush for supplying the toner is increased. As the results, the amount of the developing toner to be transposed to the photosensitive drum 22 is increased, and an increase of Member 3 becomes prominent. Moreover, in case where the deviation angle $\alpha$ of the main magnetic pole 45 of the first magnet roll 44*a* is 0 degree, the magnetic brush is in the most upright state, and hence, the scavenging amount is also increased and a minus amount in Member 2 becomes the largest. However, because an increasing amount in Member 3 is large, the final amount of the developing toner becomes the largest.

As the deviation angle α of the main magnetic pole 45 which is provided in the first magnet roll 44*a*, with respect to the closest position to the photosensitive drum 22 grows larger to a minus side (the upstream side in the rotation direction of the photosensitive drum) or a plus side (the downstream side in the rotation direction of the photosensitive drum), the amount of the additional developing toner in Member 3 is decreased. This is because the magnetic brush is inclined and gradually approaches the peripheral face of the developing roll, and the surface area of the magnetic brush where the toner is held so as to be transposed is decreased, whereby the amount of the toner to be subjected to the development is decreased. Moreover, the scavenging amount in Member 2 is also decreased by increasing the deviation angle α to the minus side or the plus side.

Meanwhile, the scavenging amount is influenced by the distance between the photosensitive drum 22 and the first developing roll 44, besides the deviation angle α of the main magnetic pole 45. As the distance becomes small, the magnetic brush is strongly rubbed to the surface of the photosensitive body and the scavenging amount is increased. As the distance becomes large, the scavenging amount is decreased.

In the same manner, concerning the second magnet roll 46*a* and the third magnet roll 48*a* too, the amount of the developing toner and the scavenging force are influenced by the deviation angle of the main magnetic pole with respect to the closest position to the photosensitive drum 22, and the distance between the surface of the photosensitive drum 22 and the surfaces of the respective developing rolls 46 and 48.

In this exemplary embodiment, in order to maintain a sufficient amount of the developing toner by the second developing roll 46 and the third developing roll 48, the deviation angles of the main magnetic poles of both the developing rolls 46 and 48 with respect to the closest position to the photosensitive drum 22 are set to be 0 degree. Moreover, in order to depress the scavenging amount, the distance between the second sleeve 46*b* and the photosensitive drum 22 is set to be 1.05 mm, and the distance between the third sleeve 48*b* and the photosensitive drum 22 is set to be 1.65 mm, which are larger than the distance 0.45 mm between the first sleeve 44*b* and the photosensitive drum 22.

In this manner, by precisely setting the positions of the magnetic poles of the three developing rolls 44, 46 and 48 and the distances between the surfaces of the developing rolls 44, 46 and 48 and the surface of the photosensitive drum, a sufficient image density is maintained, and favorable development can be performed.

Then, a method of producing the developing device in an exemplary embodiment according to the invention will be described.

The developing device as shown in FIG. 2 can be produced as follows.

The housing 42 of the developing device, the three magnet rolls 44*a*, 46*a* and 48*b* and the three sleeves 44*b*, 46*b* and 48*b* composing the developing rolls 44, 46 and 48, the supplying roll 51, the agitating transporting members 52*a* and 52*b*, and the toner supplying member 53 can be produced in the conventional method. Moreover, magnetization of the magnet rolls 44*a*, 46*a* and 48*a* can be also performed employing the conventional method.

A process for supporting these magnet rolls 44*a*, 46*a* and 48*a* by fixing them to the housing 42 can be conducted in the following manner.

In the areas around the peripheral faces of the magnet rolls 44*a*, 46*a* and 48*a*, the magnetic flux densities in a direction perpendicular to these peripheral faces are measured along the peripheral faces. For measuring the magnetic flux densities, a magnetic flux density measuring instrument using a Hall device can be employed. As shown in FIG. 4, the main magnetic pole of the first magnet roll 44*a* is provided so that a series of regions where the measured distribution of the magnetic flux density in the perpendicular direction is more than 90% of the peak value may occupy more than 40% of the entire width of the magnetic pole. Therefore, concerning the main magnetic pole of the first magnet roll 44*a*, the magnetic flux density in a direction along the peripheral face of the first magnet roll 44*a*, that is, in a tangential direction is additionally measured. The measurement can be conducted in the same manner as the measurement in the perpendicular direction.

In the wide width pole of which the distribution of the magnetic flux density in the perpendicular direction is flat near the peak value, the distribution of the magnetic flux density in the tangential direction is such that the direction of the magnetic flux is reversed in the main magnetic pole, as shown in FIG. 4. A position where the measured value of the magnetic flux density is 0 is marked as a reference point P1.

Concerning the second magnet roll 46*a* and the third magnet roll 48*a*, the measured value of the magnetic flux density in the perpendicular direction has the two maximal values, as shown in FIGS. 6 and 7. The minimal value existing between these maximal values is less than 90% of the peak value of the main magnetic pole. From such results of the measurement, a point at an equal distance from the two positions showing the maximal values on the peripheral face is marked as reference points P2 and P3.

On the other hand, the housing 42 is provided with indexes at positions where the photosensitive drum 22 comes most closely to the developing rolls 44, 46 and 48, when the developing device 40 has been installed so as to be opposed to the photosensitive drum 22. These positions on the housing 42 are set as the points existing on lines connecting respective rotation centers of the developing rolls 44, 46 and 48 with the photosensitive drum 22, when the photosensitive drum 22 has been installed, and the indexes are provided on the housing 42.

In the process for fixing the magnet rolls 44*a*, 46*a* and 48*a* to be held in the housing 42, on the basis of the indexes provided on the housing 42 as the most closest positions between the photosensitive drum 22 and the developing rolls 44, 46 and 48 and the marks of the reference points provided on the magnet rolls 44*a*, 46*a* and 48*a*, the central angles of the magnet rolls 44*a*, 46*a* and 48*a* between them are precisely set so as to be at the predetermined values, and then, the magnet rolls 44*a*, 46*a* and 48*a* are fixed. In the exemplary embodiment, the first magnet roll 44*a* is fixed so that the reference point P1 may be at 4.5 degree to the upstream side in the rotation direction of the photosensitive drum 22. The second magnet roll 46*a* and the third magnet roll 48*a* are fixed so that an angle between the closest position and the reference points P2 and P3 may be 0 degree, respectively, that is, the reference points P2 and P3 may be at the closest position, respectively.

The other members of the developing device can be assembled in the same manner as in the related art.

Then, relation between setting of the reference points of the main magnetic poles and precision when the main magnetic poles are actually arranged will be described.

The distribution of the magnetic flux density in the perpendicular direction of the main magnetic pole 45 which is provided in the first magnet roll 44*a* has a flat shape near the peak value as shown in FIG. 4, and a series of the regions where the distribution of the magnetic flux density is more than 90% of the peak value occupy more than 40% of the entire width. Therefore, it is difficult to detect the position where the magnetic flux density in the perpendicular direction reaches the peak value, and even though it has been detected, variation may occur in setting the reference point on the basis of the position of the peal value.

Figure 9:
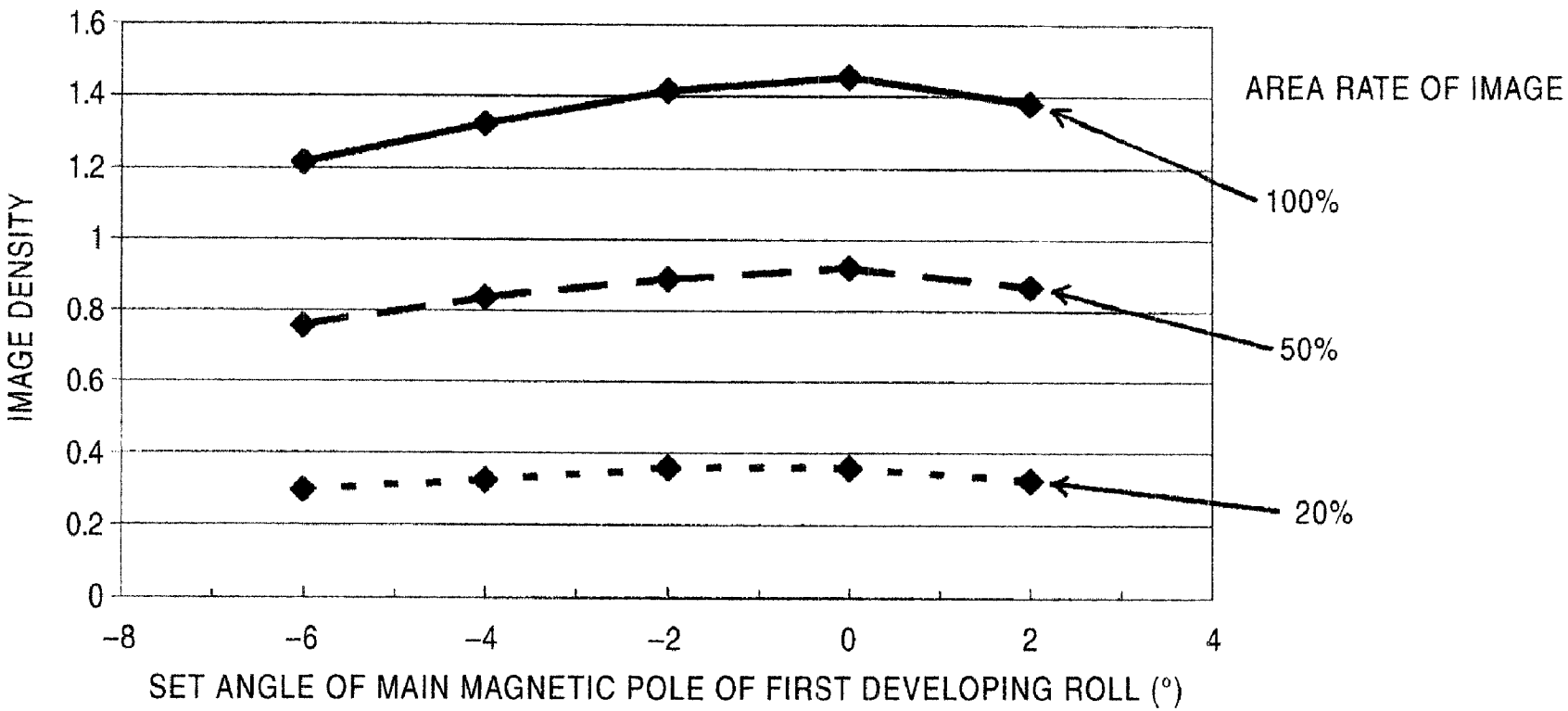
FIG. 9 is a graph showing relation between image density and an angle at which the main magnetic pole of the first developing roll as shown in FIG. 3 is deviated from the closest position where the main magnetic pole comes most closely to the photosensitive drum.

As shown in FIG. 9, the image density is remarkably influenced by the angle at which the main magnetic pole 45 of the first developing roll 44 which is arranged in the most downstream is opposed to the photosensitive drum 22. Therefore, in case where the reference point P1 of the first developing roll 44 is incorrectly set, variation occurs in the position of the main magnetic pole 45 with respect to the closest position to the photosensitive drum 22, and as the results, a big difference occurs in the image density.

On the other hand, the point where the magnetic flux density in the tangential direction (the tangential direction) is 0 is present near the position where the magnetic flux density in the perpendicular direction is at the peak value. In case where this point is set as the reference point, a difference between individuals, that is, variation in setting the reference point rarely occurs. Moreover, at the point where the magnetic flux density in the tangential direction is 0, the magnetic brush is upright substantially perpendicularly to the developing roll, and it is possible to make posture of the magnetic brush with respect to the photosensitive drum constant, in a number of apparatuses to be produced.

Accordingly, variation of developing performance between the image forming units or between the apparatuses can be restrained, by adjusting the angle of the first magnet roll 44*a* which is opposed to the photosensitive drum 22, and by adjusting the distance between the photosensitive drum 22 and the first sleeve 44*b*, on the basis of the reference point which is set at the position where the magnetic flux density in the tangential direction is 0.

On the other hand, the main magnetic pole 47 of the second developing roll 46 and the main magnetic pole 49 of the third developing roll 48 are provided in such a manner that the distribution of the magnetic flux density in the perpendicular direction has the two maximal values 47*a*, 47*b*, 49*a* and 49*b*, and the two positions of the maximal values can be accurately defined on the peripheral face. Then, by setting the point at an equal distance in the tangential direction from these two positions on the peripheral face as the reference points P2 and P3, respectively, variation is unlikely to occur in setting the reference point, and variation of the image density occurring between the image forming units or between the apparatuses can be decreased.

In the exemplary embodiment, the main magnetic pole of the first developing roll which is arranged in the most downstream in the rotation direction of the photosensitive drum is formed as the wide width pole in which the magnetic flux density in the perpendicular direction shows a high value in a wide range. However, the wide width pole may be formed in the second developing roll or the third developing roll which are arranged at the more upstream side than the first developing roll in the rotation direction of the photosensitive drum. In case where the wide width poles are formed in the second and third developing rolls, it is possible to adjust the angles at which the second and third developing rolls are opposed to the photosensitive drum, by setting the reference point at the position where the magnetic flux density in the tangential direction is 0 degree, in the same manner as in the first developing roll.

Moreover, although the three developing rolls are provided in the exemplary embodiment, it is possible to provide only one developing roll having the wide width pole as the main magnetic pole. Alternatively, it is also possible to provide at least one developing roll having the wide width pole as the main magnetic pole, and to provide two developing rolls or more than four developing rolls in all.

Further, in the exemplary embodiment, the deviation angle of the developing roll from the closest position to the photosensitive drum, and the distance between the developing rolls and the photosensitive drum are adjusted as described above. However, it is possible to appropriately adjust the deviation angle and the distance, provided that they are adjusted in such a manner that differences in the image density between the image forming units and between the apparatuses can be decreased, and images having favorable uniformity, granularity and reproducing performance of fine lines can be formed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A developing device comprising:

a magnet roll magnetized with a plurality of magnetic poles including a main magnetic pole which are arranged in a tangential direction;

a sleeve in a cylindrical shape which is arranged so as to be opposed to an image holding body having an endless peripheral face on which a latent image is formed by a difference in electrostatic potential and to which developing agent is supplied to an outer circumference face of the sleeve; and a supporting frame that stably supports the magnet roll in a manner of restraining the magnet roll from rotating in the tangential direction, and supports the sleeve so as to rotate in the tangential direction around the magnet roll, wherein the magnet roll is so arranged that the main magnetic pole is opposed to the image holding body, and a point on the peripheral face where magnetic flux density of the main magnetic pole in the tangential direction at a position along the peripheral face of the magnet roll is zero is set at a position predetermined with respect to a position where the magnet roll comes most closely to the image holding body, wherein the main magnetic pole is provided in such a manner that when magnetic flux density in a direction perpendicular to the peripheral face of the magnet roll is measured, a series of regions where distribution of the magnetic flux density in the tangential direction is more than 90% of a peak value occupy more than 40% of an entire width of the main magnetic pole.

2. The developing device according to claim 1, wherein the magnet roll is provided as a first magnet roll, and a second magnet roll and a second sleeve surrounding the second magnet roll are arranged so as to be opposed to the peripheral face of the image holding body, in addition to the first magnet roll, the second magnet roll is magnetized with a plurality of magnetic poles including a main magnetic pole opposed to the image holding body so as to be arranged in the tangential direction, distribution of magnetic flux density of the main magnetic pole of the second magnet roll in a direction perpendicular to a peripheral face of the second magnet roll has two maximal values at both sides of a minimal value where the distribution is less than 90% of a peak value, and either one of the two points on the peripheral face where the magnetic flux density of the main magnetic pole is at the maximal value or a center point between the two points is set to be as a reference point, and the second magnet roll is fixed by setting the reference point at a position predetermined with respect to a position where the second magnet roll comes most closely to the image holding body.

3. The developing device according to claim 2, wherein a first sleeve rotating around the first magnet roll and the second sleeve transpose a toner from developing agent which is held on the peripheral face of the first and second sleeve to a latent image on the image holding body, the first sleeve is arranged at a downstream side of a position where the second sleeve is opposed to the peripheral face of the image holding body in a moving direction of the image holding body, a distance between the first sleeve and the image holding body is set to be smaller than a distance between the second sleeve and the image holding body, and an amount of the toner which is transposed to the latent image on the image holding body when the image holding body has passed the position opposed to the first sleeve is so set as to be smaller than an amount of the toner which has been transposed when the image holding body has passed the position opposed to the second sleeve.

4. An image forming apparatus comprising:

an image holding body having an endless peripheral face on which a latent image by a difference in electrostatic potential is formed;

a developing device that applies toner to the latent image on the image holding device thereby to form a toner image:

a transferring device that transfers the toner image to a transfer material; and a fixing device that fixes the toner image to the transfer material, wherein the developing device includes the developing device according to claim 3.

5. An image forming apparatus comprising:

an image holding body having an endless peripheral face on which a latent image by a difference in electrostatic potential is formed;

a developing device that applies toner to the latent image on the image holding device thereby to form a toner image:

a transferring device that transfers the toner image to a transfer material; and a fixing device that fixes the toner image to the transfer material, wherein the developing device includes the developing device according to claim 2.

6. An image forming apparatus comprising:

an image holding body having an endless peripheral face on which a latent image by a difference in electrostatic potential is formed;

a developing device that applies toner to the latent image on the image holding device thereby to form a toner image:

a transferring device that transfers the toner image to a transfer material; and a fixing device that fixes the toner image to the transfer material, wherein the developing device includes the developing device according to claim 1.

7. A method of producing a developing device comprising:

providing a plurality of magnetic pole including a main magnetic pole on a peripheral face of a magnet roll in a cylindrical shape so as to be arranged in a tangential direction;

measuring magnetic flux density of the main magnetic pole in a tangential direction at a position along the peripheral face of the magnet roll, and detecting a point where the magnetic flux density is zero; and supporting the magnet roll by fixing it to a supporting frame of a developing device which transposes a toner to a latent image by a difference in electrostatic potential thereby to form a visual image, and at the same time, supporting a sleeve in a cylindrical shape around the magnet roll so as to rotate in a tangential direction, wherein, when the magnet roll is fixed to the supporting frame of the developing device, the magnetic roll is adjusted and fixed in such a manner that when the magnet roll is supported so as to be opposed to an image holding body on a surface of which the latent image is formed, by setting a reference point at a position on the peripheral face where the magnetic flux density of the main magnetic pole in the tangential direction is zero, the reference point is the position which has been predetermined with respect to a position where the image holding body comes most closely to the magnet roll, wherein the main magnetic pole is provided in such a manner that when the magnetic flux density in a direction perpendicular to the peripheral face of the magnet roll is measured, a series of regions where distribution of the magnetic flux density in the tangential direction is more than 90% of a peak value occupy more than 40% of an entire width of the main magnetic pole.

8. The method according to claim 7, further comprising:

providing the magnet roll as a first magnet roll, and providing a plurality of magnetic poles including a main magnetic pole on a peripheral face of a second magnet roll different from the first magnet roll so as to be arranged in a tangential direction;

measuring, along a tangential direction, magnetic flux density of the main magnetic pole which has been provided in the second magnet roll in a direction perpendicular to the peripheral face of the magnet roll thereby to detect a point where the magnetic flux density is at a maximal value; and supporting the second magnet roll by fixing the second magnet roll to the supporting frame, and at the same time, supporting a second sleeve in a cylindrical shape around the second magnet roll so as to rotate in a tangential direction, wherein, when the main magnetic pole is provided on the second magnet roll, the main magnetic pole is provided in such a manner that distribution of the magnetic flux density in the direction perpendicular to the peripheral face of the second magnet roll has two maximal values at both sides of a minimal value where the distribution is less than 90% of the peak value, and when the second magnet roll is fixed to the supporting frame, the second magnetic roll is adjusted and fixed in such a manner that when the second magnet roll is supported so as to be opposed to an image holding body on a surface of which the latent image is formed, by setting a reference point at either one of two points on the peripheral face where the magnetic flux density of the second main magnetic pole in the tangential direction is at maximal values or a center point between them, the reference point is the position which has been predetermined with respect to a position where the image holding body comes most closely to the second magnet roll.

* * * * *